US011535921B2

(12) United States Patent
Hou et al.

(10) Patent No.: US 11,535,921 B2
(45) Date of Patent: Dec. 27, 2022

(54) METHOD AND DEVICE FOR CONTROLLING FLOW OF LIQUID ZINC IN ZINC POT FOR HOT-DIP GALVANIZATION

(71) Applicant: BAOSHAN IRON & STEEL CO., LTD., Shanghai (CN)

(72) Inventors: Xiaoguang Hou, Shanghai (CN); Hongwei Qian, Shanghai (CN); Lei Yu, Shanghai (CN); Shanqing Li, Shanghai (CN); Yong Lu, Shanghai (CN); Xinyan Jin, Shanghai (CN); Yueming Zhou, Shanghai (CN); Jun Shen, Shanghai (CN); Cunbing Wang, Shanghai (CN); Bing Yang, Shanghai (CN); Hui Wang, Shanghai (CN); Hao Xu, Shanghai (CN); Tingquan Gu, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 480 days.

(21) Appl. No.: 16/492,011

(22) PCT Filed: Mar. 16, 2018

(86) PCT No.: PCT/CN2018/079296
§ 371 (c)(1),
(2) Date: Sep. 6, 2019

(87) PCT Pub. No.: WO2018/223746
PCT Pub. Date: Dec. 13, 2018

(65) Prior Publication Data

US 2020/0010943 A1 Jan. 9, 2020

(30) Foreign Application Priority Data

Jun. 6, 2017 (CN) ..... 201710417938.7

(51) Int. Cl.
*C23C 2/00* (2006.01)
*C23C 2/06* (2006.01)
(Continued)

(52) U.S. Cl.
CPC ..... *C23C 2/003* (2013.01); *B05C 3/02* (2013.01); *C23C 2/06* (2013.01); *C23C 2/40* (2013.01)

(58) Field of Classification Search
None
See application file for complete search history.

(56) References Cited

U.S. PATENT DOCUMENTS 4,296,145 A * 10/1981 Higuchi ..... C23C 2/006 427/349
2013/0180076 A1* 7/2013 Jang ..... C23C 2/06 15/3

(Continued)

FOREIGN PATENT DOCUMENTS

CN 104040013 A 9/2014
CN 106282470 A 1/2017

(Continued)

OTHER PUBLICATIONS

International Search Report for related International Application No. PCT/CN2018/079296 dated May 18, 2018; 2 pages.

(Continued)

*Primary Examiner* — Jethro M. Pence
(74) *Attorney, Agent, or Firm* — Procopio, Cory, Hargreaves & Savitch LLP

(57) ABSTRACT

Disclosed are a method and a device for controlling flow of liquid zinc (2) in a zinc pot (1) for hot-dip galvanization. Under the blowing effects of an air knife above the zinc pot (1) for hot-dip galvanization onto strip steel (3), the liquid zinc (2) diffuses and flows outwards to zones (zones I, II, III (Continued)

and IV) comprising the left side, the right side, the front end of the zinc pot, respectively, and a zone between the strip steel (3) and a furnace snout (4), and surface dross rapidly generated on the surface of the liquid zinc (2) is driven to flow outwards to the zones (zones I, II, III and IV). On edge sides of the zones (zones I, II, III and IV), travelling magnetic field generators (71, 72, 73, 74, 75, 76, 77, 78, 712, 756) are arranged in multiple sections above the surface of the liquid zinc (2) in the zinc pot (1), so as to excite a travelling magnetic field to generate an electromagnetic driving force on the liquid zinc (2) to drive the flow of the liquid zinc (2). The flow of the liquid zinc (2) caused by the travelling magnetic field generators (71, 72, 73, 74, 75, 76, 77, 78, 712, 756) is engaged with the blowing flow of the air knife, driving the surface liquid zinc (2) in the zinc pot (1) to flow in order towards a rear end (zone V) of the zinc pot (1). The surface dross floating on the surface of the liquid zinc (2) is driven by the flowing liquid zinc (2) to flow in a controlled direction.

6 Claims, 4 Drawing Sheets

(51) Int. Cl.
*C23C 2/40* (2006.01)
*B05C 3/02* (2006.01)

(56) References Cited

U.S. PATENT DOCUMENTS

| | | | | |
|---|---|---|---|---|
| 2014/0329033 | A1* | 11/2014 | Anderhuber | C23C 2/06 427/598 |
| 2014/0356548 | A1* | 12/2014 | Jang | C23C 2/14 427/547 |
| 2018/0010225 | A1* | 1/2018 | Kweon | C23C 2/16 |

FOREIGN PATENT DOCUMENTS

| | | | |
|---|---|---|---|
| EP | 2768996 | A | 8/2014 |
| JP | 2014530960 | A1 | 11/2014 |
| KR | 1020160079613 | A | 7/2016 |
| WO | 2013057385 | A | 4/2013 |
| WO | 2016105047 | A1 | 6/2016 |

OTHER PUBLICATIONS

Extended European Search Report for related EP App No. 18813530.5 dated Dec. 11, 2020, 6 pgs.
First Office Action for related CA App No. 3,051,026 dated Dec. 3, 2020, 3 pgs.
First Office Action for related IN App No. 201947033659 dated Nov. 30, 2020, 7 pgs.
Office Action for related JP App No. 2019-559155 dated Aug. 4, 2020, 10 pgs.
Office Action for related KR App No. 10-2019-7024118 dated Jan. 2, 2021, 11 pgs.

* cited by examiner

METHOD AND DEVICE FOR CONTROLLING FLOW OF LIQUID ZINC IN ZINC POT FOR HOT-DIP GALVANIZATION

CROSS-REFERENCE TO RELATED APPLICATIONS

This application is a U.S. National Stage entry of PCT Application No: PCT/CN2018/079296 filed Mar. 16, 2018, which claims priority to Chinese Patent Application No. 201710417938.7, filed Jun. 6, 2017, the contents of which are incorporated herein by reference.

TECHNICAL FIELD

The invention relates to the technical field of hot-dip galvanizing, in particular to a method and a device for controlling the flow of liquid zinc in a zinc pot for hot-dip galvanization.

BACKGROUND ART

It is well known that the hot dip galvanizing process is carried out by strip steel through a zinc pot. In the process, the high-speed strip steel entering the zinc pot, the movement of the sink roll assembly in the zinc pot, and the blowing effects of the air knife inevitably cause the flow of the liquid zinc. At the same time, the liquid zinc and the aluminum component in the zinc pot, which are particularly active at a high temperature (about 450° C., the temperature of the Galvalume coating pot is up to 650° C.), undergo a complicated chemical reaction with the Fe element brought by the steel strip to form a Zn—Fe—Al ternary metal compound, that is, zinc dross. Zinc dross can be divided into surface dross (also known as scum), suspended dross and bottom dross based on different density and composition.

In the prior art, the flow of liquid zinc in the zinc pot interacts with the zinc dross, which causes different degrees of adverse effects on the hot-dip galvanizing production and the surface quality of the strip steel. The bottom dross is easily precipitated due to its large particles. Therefore, in the general hot-dip galvanizing production, the flow of liquid zinc caused by the high-speed strip steel entering the zinc pot and the movement of the sink roll assembly generally does not roll up the bottom dross, and has little influence on the surface quality of the steel strip and the smooth production. When the amount of precipitated bottom dross is too much, the effect of the bottom dross on the hot-dip galvanizing production can be eliminated by regular bottom dross cleaning (generally every tens of days or more). Although the second type (i.e. suspended zinc dross) is most difficult to remove in a zinc pot, it can be controlled by conversion (i.e., conversion of suspended dross to surface dross) by precisely controlling the temperature of the zinc pot and the content of Al in the liquid zinc. Moreover, the particle size of the newly formed suspended dross is generally small, and its influence on the surface quality of the strip steel product is still within the acceptable range of hot-dip galvanizing production. However, the third type (i.e., surface dross) floats on the surface of the liquid zinc in the zinc pot due to the low density. The interaction of the surface dross with the flow on the zinc pot surface has a great influence on the smooth production of hot-dip galvanizing. The specific explanation is as follows: FIG. 1 is a schematic diagram showing the flow of the liquid zinc in the zinc pot caused by the blowing effects of the air knife in the prior art. In the figure, the liquid zinc 2 in the zinc pot 1 is divided into five zones (zone I, II, III, IV and V), wherein, the left and right sides of the zinc pot are Zone I and Zone II, the front end of the zinc pot is Zone III, and the zone between the strip steel 3 and the furnace snout 4 is the Zone IV. These four zones are collectively referred to as the hot-dip zone of the zinc pot, in which the strip steel 3 is hot-dip galvanized, and which is a key zone for hot-dip galvanizing production of strip steel. The Zone V is the auxiliary zone of the zinc pot, which is located at the rear end of the zinc pot, and mainly performs operations such as adding zinc ingots and dross dredging of surface dross in zinc pot. In the hot dip galvanizing production, an air knife (not shown) ejects gas to the strip steel 3 to control the thickness of the zinc layer. At the same time, the gas ejected by the air knife is blocked by the steel strip, generating the downward blowing effects on the liquid zinc, causing the liquid zinc to diffuse and flow around the hot-dip zone (zones I~IV) centering on the strip steel 3. Due to the blockage of the zinc pot wall around the hot-dip zone and the furnace snout 4, and the structure of the air knife itself and the like, the diffusion of liquid zinc exhibits outward diffusion with an uneven diffusion rate and different diffusion directions, as indicated by arrow 5 in FIG. 1. The liquid zinc diffuses along the center line 30 of the strip steel to both sides of the hot-dip zone respectively (the middle flow is weak, the flow on both sides is slightly stronger), forming a streamline 6 resembling a saddle shape. Moreover, the farther the distance from the blowing effects of air knife, the smaller the diffusion speed of the saddle-shaped streamline. At the same time, the diffusion of the liquid zinc caused by the blowing effects of the air knife inevitably causes the surface dross floating on the surface of the liquid zinc to be driven to the outside of the saddle-shaped streamline 6. The flow of liquid zinc outside the saddle-shaped streamline 6 becomes so weak that it is insufficient to continue to promote the movement of the surface dross, thereby causing the surface dross to accumulate and agglomerate around the hot-dip zone (zones I~IV), which seriously affects the smoothing of the hot-dip galvanizing production. At present, it is generally required to manual clean the dross once every 1~2 hours, which not only increases the intensity of manual labor, but also limits the development of automation of zinc pot. Moreover, the manual cleaning of the dross limits the further increase in the unit speed, and restricts the further improvement in production efficiency.

On the other hand, the surface liquid zinc in the zinc pot is easily oxidized. Excessive flow of liquid zinc will inevitably increase the amount of surface dross formed in the zinc pot and the loss of zinc resources. Therefore, it is necessary to timely control the surface flow of the liquid zinc to reduce the surface oxidation of the liquid zinc.

It can be seen from the above description that the flow of liquid zinc in the zinc pot and the generation of zinc dross during the hot dip galvanizing production are interrelated. Therefore, in order to overcome the adverse effects of zinc dross on the efficiency of hot-dip galvanizing production and product quality, it is necessary to effectively control the flow of liquid zinc in the zinc pot. It is necessary to fully improve the surface flow of the liquid zinc around the zinc pot for hot-dip galvanizing to improve the distribution of the zinc dross and prevent the agglomeration of the zinc dross, and also it is necessary to take the flow strength and direction of the liquid zinc into fully consideration to avoid excessive oxidation and excessive agitation caused by excessive flow of the liquid zinc surface.

In the prior art, Korean Patent KR1020160079613A and WO2016105047A1 disclosed a circular roller inset with a plurality of permanent magnet materials. In the patent, an electromagnetic driving force for cutting the magnetic line on liquid zinc is generated by the high-speed rotation of the circular roller in order to adjust the flow of the liquid zinc to drive away the zinc dross. This patent is characterized by non-contact operation and has significant technical advantages over immersed mechanical structures. However, the patent still retains high-speed rotating moving parts, which inevitably reduces the reliability and service life of the device system. Moreover, the moving parts of this patent require a large installation and operation space, and there are disadvantages in the arrangement above the zinc pot.

The patent CN201510311172.5 filed by the present inventor disclosed a non-contact iron ladle slag conglomerating and skimming method. The patent utilizes a traveling wave electromagnetic field having a similar working principle as that of a linear motor to drive the molten iron in the iron ladle, thereby controlling the flow of molten iron for repelling the slag. However, the patent is mainly for a round iron ladle, and has relatively simple arrangement of the traveling wave magnetic field and simple control of the magnetic field direction, and it needs to cooperate with a slag tank to operation properly. Moreover, the purpose of the patent is simply to remove the slag without regard to the influence of the flow of molten iron on the quality of the product.

SUMMARY OF THE INVENTION

It is an object of the present invention to provide a method and a device for controlling flow of liquid zinc in a zinc pot for hot-dip galvanization. The invention can effectively change the flow speed and direction of the liquid zinc around the hot-dip zone (zones I~IV), thereby driving the zinc dross to the rear end (zone V) of the zinc pot by the flow of the liquid zinc. Moreover, the invention can prevent excessive agitation and surface oxidation of liquid zinc by alternately controlling the flow of liquid zinc, thereby reducing the consumption of zinc resources.

In order to achieve the above technical purpose, the present invention uses the following technical solutions:

A method for controlling flow of liquid zinc in a zinc pot for hot-dip galvanization, wherein, under the blowing effects of an air knife above the zinc pot for hot-dip galvanization onto strip steel, the liquid zinc diffuses and flows outwards to zones comprising the left side, the right side, the front end of the zinc pot, respectively, and a zone between the strip steel and a furnace snout, and surface dross rapidly generated on the surface of the liquid zinc is driven to flow outwards to the zones; on edge sides of the zones, traveling wave magnetic field generators are arranged in multiple sections above the surface of the liquid zinc in the zinc pot, so as to excite a traveling wave magnetic field to generate an electromagnetic driving force on the liquid zinc, driving the liquid zinc to flow; flowing of the liquid zinc caused by the traveling wave magnetic field generators is engaged with blow-flowing of the air knife, driving the liquid zinc on the surface of the zinc pot to flow in order towards a rear end of the zinc pot; the surface dross floating on the surface of the liquid zinc is driven by the flowing liquid zinc to flow in a controlled direction.

Further, traveling wave magnetic field generators arranged in multiple sections include transverse traveling wave magnetic field generators and longitudinal traveling wave magnetic field generators. Traveling wave magnetic field generators arranged in multiple sections form a circle around the strip steel, and the longitudinal traveling wave magnetic field generators extend toward the rear end of the zinc pot. The transverse traveling wave magnetic field generators include front traveling wave magnetic field generators and back traveling wave magnetic field generators. The longitudinal traveling wave magnetic field generator includes left traveling wave magnetic field generators and right traveling wave magnetic field generators.

A device for controlling flow of liquid zinc in a zinc pot for hot-dip galvanization is provided, comprising transverse traveling wave magnetic field generators and longitudinal traveling wave magnetic field generators, and a control device for the traveling wave magnetic field generators;

Left, right, front and back traveling wave magnetic field generators are disposed above the surface of the liquid zinc on a left side, a right side, a front end of the zinc pot and the zone between a strip steel and a furnace snout, respectively; the front traveling wave magnetic field generators and the back traveling wave magnetic field generators constitute the transverse traveling wave magnetic field generators; the left traveling wave magnetic field generators and the right traveling wave magnetic field generators constitute the longitudinal traveling wave magnetic field generators.

The left traveling wave magnetic field generator and the right traveling wave magnetic field generator extend beyond the back traveling wave magnetic field generator to the rear end of the zinc pot.

Further, the front traveling wave magnetic field generators comprise a first front traveling wave magnetic field generator and a second front traveling wave magnetic field generator. The back traveling wave magnetic field generators comprise a first back traveling wave magnetic field generator and a second back traveling wave magnetic field generator. The left traveling wave magnetic field generators, the first front traveling wave magnetic field generator, the first back traveling wave magnetic field generator are arranged in symmetry with the right traveling wave magnetic field generator, the second front traveling wave magnetic field generator, the second back traveling wave magnetic field generator on both sides of the center line of the width of the strip steel.

Still further, the first front traveling wave magnetic field generator and the first back traveling wave magnetic field generator excite the traveling wave electromagnetic fields that drive the liquid zinc to flow to the left side of the zinc pot. The left traveling wave magnetic field generators excite the traveling wave electromagnetic fields that drive the liquid zinc to flow to the rear end of the zinc pot. Similarly, the second front traveling wave magnetic field generator and the second back traveling wave magnetic field generator excite the traveling wave electromagnetic fields that drive the liquid zinc to flow to the right side of the zinc pot. The right traveling wave magnetic field generators excite the traveling wave electromagnetic fields that drive the liquid zinc to flow to the rear end of the zinc pot.

The left traveling wave magnetic field generators include a first left traveling wave magnetic field generator and a second left traveling wave magnetic field generator. The right traveling wave magnetic field generators include a first right traveling wave magnetic field generator and a second right traveling wave magnetic field generator.

The control device for the traveling wave magnetic field generators controls the energizing interval of the traveling wave magnetic field generators to control alternately flowing of the liquid zinc.

The control device for the traveling wave magnetic field generators controls power supply frequency of the traveling wave magnetic field generators to be 0~200 Hz.

Further, the control device for the traveling wave magnetic field generators controls power supply frequency of the traveling wave magnetic field generators to be 50~100 Hz.

The method and the device for controlling the flow of liquid zinc in a zinc pot for hot-dip galvanization of the present invention achieve the purpose of orderly controlling the flow of the surface liquid zinc around the zinc pot by setting a plurality of traveling wave magnetic field generators (transverse and longitudinal) around the hot-dip zone of the zinc pot and by using different combinations of the traveling wave magnetic field generator to excite the traveling wave magnetic field in different directions. The invention not only realizes the flow of liquid zinc outside the blowing zone of air knife to repelling the dross, but also realizes alternately flowing of the liquid zinc by energinzing control of the traveling wave electromagnetic field. The invention prevents the excessive oxidation of the surface of the liquid zinc and the consumption of zinc resources while avoiding the accumulation and agglomeration of the surface dross in zinc pot, which has important significance and value for reducing manual labor, improving the automation level of the zinc pot and the production efficiency. At the same time, the present invention achieves zinc liquid flow control under non-contact conditions. In the present invention, there is no contamination of liquid zinc since no external device enters the liquid zinc during the entire operation, and the reliability and service life of the device are improved because there are no mechanical moving parts.

By the combination and sequential control of a plurality of traveling wave magnetic field generators, the invention improves the flow of liquid zinc in the hot-dip zone (zones I~IV) of the zinc pot, progressively converts the transverse flow of the liquid zinc into a longitudinal flow, thereby changing the flow state of liquid zinc in the zinc pot of the prior art, and promoting the orderly flow of the zinc dross, which greatly reduces the manual operation, helps to improve the automation level of the zinc pot, greatly increases the speed of the unit, and reduces the excessive consumption of raw materials for production.

DETAILED DESCRIPTION

The invention will be further described below in conjunction with the drawings and specific Examples.

Figure 2:
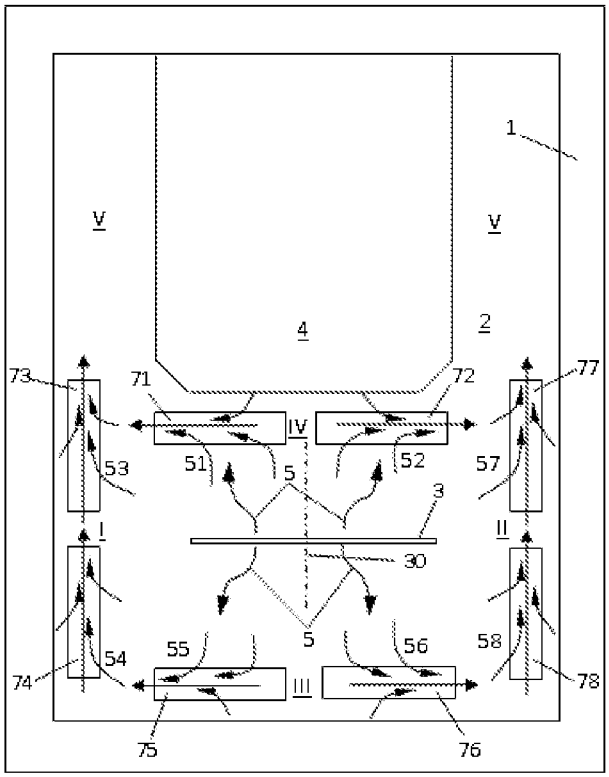
FIG. 2 is a schematic plan view showing the method for controlling the flow of liquid zinc in a zinc pot for hot-dip galvanization of the present invention (Example 1).
Figure 3:
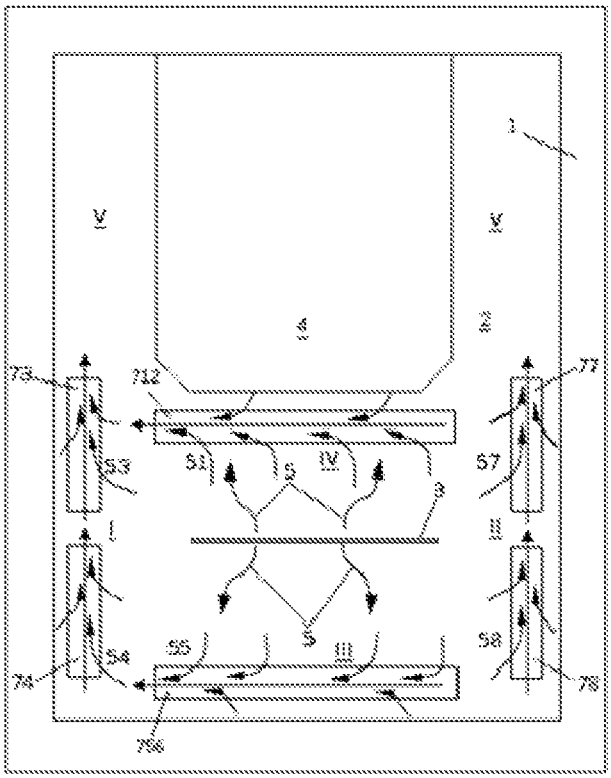
FIG. 3 is a schematic plan view showing the method for controlling the flow of liquid zinc in a zinc pot for hot-dip galvanization of the present invention (Example 2).

As can be seem from FIG. 2 and FIG. 3, in a method for controlling flow of liquid zinc in a zinc pot for hot-dip galvanization, under the blowing effects of an air knife above the zinc pot 1 for hot-dip galvanization onto strip steel 3, the liquid zinc 2 respectively diffuses and flows outwards to zones comprising the left side, the right side, the front end of the zinc pot, respectively, and a zone between the strip steel 3 and a furnace snout 4, and surface dross rapidly generated on the surface of the liquid zinc is driven to flow outwards to the zones. On edge sides of the zones, traveling wave magnetic field generators are arranged in multiple sections above the surface of the liquid zinc in the zinc pot, so as to excite a traveling wave magnetic field to generate an electromagnetic driving force on the liquid zinc, driving the liquid zinc to flow. Flowing of the liquid zinc caused by the traveling wave magnetic field generators is engaged with blow-flowing of the air knife, driving the liquid zinc on the surface of the zinc pot to flow in order towards both sides of a rear end of the zinc pot by controlling the magnetic field direction and the energizing interval of the traveling wave magnetic field generators. The surface dross floating on the surface of the liquid zinc is driven by the flowing liquid zinc to flow in a controlled direction.

Traveling wave magnetic field generators arranged in multiple sections include transverse traveling wave magnetic field generators and longitudinal traveling wave magnetic field generators. Traveling wave magnetic field generators arranged in multiple sections form a circle around the strip steel, and the longitudinal traveling wave magnetic field generators extend toward the rear end of the zinc pot. The transverse traveling wave magnetic field generators include front traveling wave magnetic field generators and back traveling wave magnetic field generators. The longitudinal traveling wave magnetic field generator includes left traveling wave magnetic field generators and right traveling wave magnetic field generators.

A device for controlling flow of liquid zinc in a zinc pot for hot-dip galvanization is provided, comprising transverse traveling wave magnetic field generators and longitudinal traveling wave magnetic field generators, and a control device for the traveling wave magnetic field generators; left, right, front and back traveling wave magnetic field generators are disposed above the surface of the liquid zinc 2 on the left side, the right side, the front end of the zinc pot 1 and the zone between a strip steel 3 and a furnace snout 4, respectively; the front traveling wave magnetic field generators and the back traveling wave magnetic field generators constitute the transverse traveling wave magnetic field generators; the left traveling wave magnetic field generators and the right traveling wave magnetic field generators constitute the longitudinal traveling wave magnetic field generators. The left traveling wave magnetic field generator and the right traveling wave magnetic field generator extend beyond the back traveling wave magnetic field generator to the rear end of the zinc pot.

The front traveling wave magnetic field generators comprise a first front traveling wave magnetic field generator 75 and a second front traveling wave magnetic field generator 76. Alternatively, the front traveling wave magnetic field generator can also be a full-length front traveling wave magnetic field generator 756. The back traveling wave magnetic field generators comprise a first back traveling wave magnetic field generator 71 and a second back traveling wave magnetic field generator 72. Alternatively, the back traveling wave magnetic field generator can also be a full-length back traveling wave magnetic field generator 712, as shown in FIG. 2 and FIG. 3. The left traveling wave magnetic field generators, the first front traveling wave magnetic field generator 75, the first back traveling wave magnetic field generator 71 are arranged in symmetry with the right traveling wave magnetic field generators, the second front traveling wave magnetic field generator 76, the second back traveling wave magnetic field generator 72 on both sides of the center line 30 of the width of the strip steel.

The first front traveling wave magnetic field generator 75 and the first back traveling wave magnetic field generator 71 excite the traveling wave electromagnetic fields that drive the liquid zinc to flow to the left side of the zinc pot. The left traveling wave magnetic field generators excite the traveling wave electromagnetic fields that drive the liquid zinc to flow to the rear end of the zinc pot. Similarly, the second front traveling wave magnetic field generator 76 and the second back traveling wave magnetic field generator 72 excite the traveling wave electromagnetic fields that drive the liquid zinc to flow to the right side of the zinc pot. The right traveling wave magnetic field generators excite the traveling wave electromagnetic fields that drive the liquid zinc to flow to the rear end of the zinc pot, as shown in FIG. 2.

The left traveling wave magnetic field generators include a first left traveling wave magnetic field generator 73 and a second left traveling wave magnetic field generator 74. The right traveling wave magnetic field generators include a first right traveling wave magnetic field generator 77 and a second right traveling wave magnetic field generator 78.

Moreover, alternately flowing of the liquid zinc is controlled by controlling the energizing interval of the traveling wave magnetic field generators. When the traveling wave magnetic field generators are powered, the excited traveling wave electromagnetic fields drive the flow of liquid zinc; when the traveling wave magnetic field generators are not powered, the liquid zinc does not flow. In this way, the control of the flow of liquid zinc is achieved, and the consumption of zinc resources caused by the oxidation of the surface of the liquid zinc is prevented to some extent.

At the same time, by controlling power supply frequency of the traveling wave magnetic field generator, the depth of action of the traveling wave magnetic field on the liquid zinc is controlled, so as to prevent excessive agitation at a depth below the surface layer of the liquid zinc.

Example 1

As shown in FIG. 2, a total of eight traveling wave magnetic field generators are arranged on the left and right sides (zones I and II), the front end (zone III) of the hot-dip zone of the zinc pot 1, and the area (zone IV) between the strip steel 3 and the furnace snout 4, which are: the first left traveling wave magnetic field generator 73, the second left traveling wave magnetic field generator 74, the first right traveling wave magnetic field generator 77, the second right traveling wave magnetic field generator 78, the first front traveling wave magnetic field generator 75, the second back traveling wave magnetic field generator 76, the first back traveling wave magnetic field generator 71, and the second back traveling wave magnetic field generator 72.

The first left traveling wave magnetic field generator 73, the second left traveling wave magnetic field generator 74, the first front traveling wave magnetic field generator 75, the first back traveling wave magnetic field generator 71 are arranged in symmetry with the first right traveling wave magnetic field generator 77, the second right traveling wave magnetic field generator 78, the second front traveling wave magnetic field generator 76, the second back traveling wave magnetic field generator 72 on both sides of the center line 30 of the width of the strip steel 3. The first left traveling wave magnetic field generator 73 and the second left traveling wave magnetic field generator 74 are disposed on the left side of the zinc pot near the wall surface of the zinc pot (zone I). The first right traveling wave magnetic field generator 77 and the second right traveling wave magnetic field generator 78 are disposed on the right side of the zinc pot near the wall surface of the zinc pot (zone II). In addition, the longitudinal traveling wave magnetic field generators extend toward the rear end of the zinc pot, i.e., the first left traveling wave magnetic field generator 73 extend beyond the first back traveling wave magnetic field generator 71 to the rear end of the zinc pot; likewise, the first right traveling wave magnetic field generator 77 extend beyond the second back traveling wave magnetic field generator 72 to the rear end of the zinc pot, to guide the liquid zinc to flow toward the rear end of the zinc pot.

By respectively controlling the traveling wave magnetic field generators disposed transversely, i.e., the first back traveling wave magnetic field generator 71 and the second back traveling wave magnetic field generator 72, the first front traveling wave magnetic field generator 75 and the second front traveling wave magnetic field generator 76, the electromagnetic fields excited thereof are in the opposite direction, that is, symmetrically opposite to each other on both sides of the center line 30 of the width of the strip steel and directing to the wall surfaces on both sides of the zinc pot. Moreover, by respectively controlling the traveling wave magnetic field generators disposed longitudinally on both sides of the zinc pot (zone I and zone II), i.e., the first left traveling wave magnetic field generator 73 and the second left traveling wave magnetic field generator 74, the first right traveling wave magnetic field generator 77 and the second right traveling wave magnetic field generator 78, the traveling wave electromagnetic fields directing to the rear end (zone V) of the zinc pot are excited.

The electromagnetic field excited by each of the traveling wave magnetic field generators can generate an electromagnetic driving force for cutting the magnetic line on the liquid zinc. Thus, the liquid zinc in the hot-dip zone (zones I~IV) of the zinc pot which cannot flow only by the blowing effects of the air knife (since the farther the distance from the air knife, the weaker the flow) is re-driven by the electromagnetic force of the traveling wave magnetic field generators disposed transversely. Further, the flow direction of the liquid zinc is controlled by the direction of the electromagnetic field, and the flow directions are as indicated by arrows 51 and 52, and arrows 55 and 56, respectively. In this way, the flow of the liquid zinc driven by the electromagnetic force excited by the transversely disposed traveling wave magnetic field generators is engaged with and the flow of the liquid zinc (flow direction is indicated by arrow 5) caused by the blowing effects of the air knife (not shown). Moreover, the traveling wave magnetic field generators disposed longitudinally on both sides (zone I and zone II) of the zinc pot excite traveling wave electromagnetic fields directing to the rear end (zone V) of the zinc pot to drive the liquid zinc to flow toward the rear end of the zinc pot. The flow direction of the liquid zinc is indicated by arrows 53 and 54, and arrows 57 and 58, respectively. In this way, the flow of the liquid zinc caused by the transversely disposed traveling wave magnetic field generators and the flow of the liquid zinc caused by the longitudinally disposed traveling wave magnetic field generators are also engaged with each other, so that the surface liquid zinc in the hot-dip zone of the entire zinc pot flows in an orderly and controllable manner. In addition, the first left traveling wave magnetic field generator 73 and the first right traveling wave magnetic field generator 77 longitudinally disposed extend beyond the back traveling wave magnetic field generators 71 and 72 transversely disposed to the rear end of the zinc pot, to guide the liquid zinc to flow toward the rear end of the zinc pot. Thus, the surface dross floating on the surface of the liquid zinc is inevitably driven by the flowing liquid zinc to flow to the rear end (zone V) of the zinc pot in a controlled direction, and then removed by a mechanical arm.

Both the transverse and longitudinal disposed traveling wave magnetic field generators are equally divided into two sections, which can effectively engage with the flow caused by the blowing effects of air knife, so that the flow of the liquid zinc is shunted along the center line of the strip steel. It not only ensures the flow efficiency of the liquid zinc, but also makes full use of the flow energy of the air knife blowing.

By the combination and sequential control of a plurality of traveling wave magnetic field generators, the invention improves the flow of liquid zinc in the hot-dip zone (zones I~IV) of the zinc pot, progressively converts the transverse flow of the liquid zinc into a longitudinal flow, thereby changing the flow state of liquid zinc in the zinc pot of the prior art, and promoting the orderly flow of the zinc dross, which greatly reduces the manual operation, helps to improve the automation level of the zinc pot, greatly increases the speed of the unit, and reduces the excessive consumption of raw materials for production.

On the other hand, the liquid zinc on the surface of the zinc pot is easily oxidized, and the continuous flow on the surface of the liquid zinc inevitably increases the excessive oxidation of the liquid zinc, resulting in an increase in zinc resource consumption or zinc dross formation. The present invention controls alternately flowing of liquid zinc by controlling the energizing interval and duration of operation of the traveling wave magnetic field generators. For example, an alternating sequence of 5 min (energizing interval)-3 min (duration of operation)-5 min is used to cause the liquid zinc to flow while the traveling wave magnetic field generators are continuous operating, and substantially does not flow during the energizing interval. It not only achieves the orderly control of the flow of liquid zinc, but also reduces the consumption of zinc resources caused by the oxidation of the surface of liquid zinc to some extent.

At the same time, the power supply frequency of the traveling wave magnetic field generators is controlled to control the depth of action of the traveling wave magnetic field on the liquid zinc. Generally, the lower the power supply frequency of the traveling wave magnetic field generators, the greater the depth of action of the generated electromagnetic driving force on the liquid zinc, and the greater the agitation of the liquid zinc under the surface layer. The traveling wave magnetic field generators of the present invention have a power supply frequency of 0~200 Hz, preferably 50~100 Hz.

Example 2

As shown in FIG. 3, the transversely disposed traveling wave magnetic field generators located at the front end of the zinc pot (zone III) and the area between the strip steel and the furnace snout (zone IV) are full-length traveling wave magnetic field generators, i.e., a front traveling wave magnetic field generator 756 and a back traveling wave magnetic field generator 712. Moreover, the traveling wave magnetic fields excited by the full-length traveling wave magnetic field generators are in the same direction to drive the liquid zinc to flow to one side of the zinc pot, and make it be engaged with the flow of liquid zinc caused by the traveling wave magnetic field generators located on the side of the zinc pot, diverting the liquid zinc driven by the transverse traveling wave magnetic field generators to the rear end (zone V) of the zinc pot.

Figure 1:
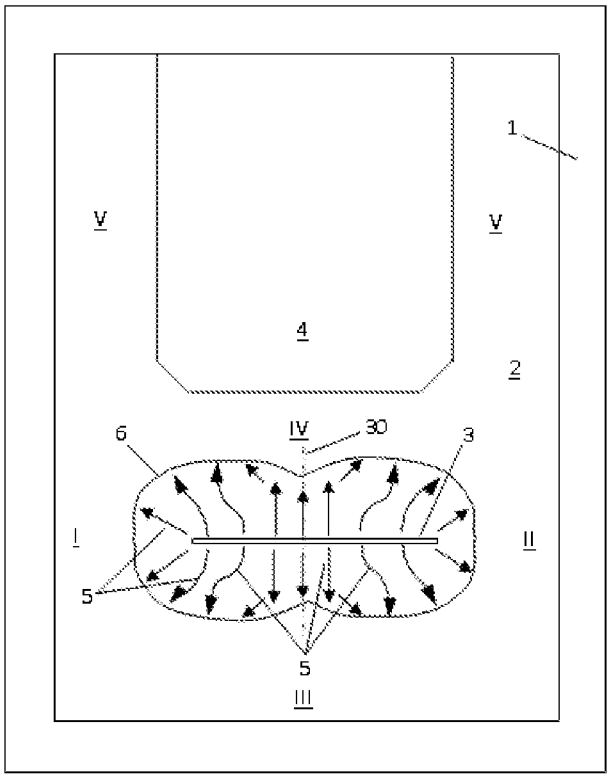
FIG. 1 is a schematic view showing the flow of liquid zinc in a zinc pot due to the blowing effects of air knife in the prior art.

As can be seen from FIG. 1, in the prior art, under the blowing effects of the air knife, the liquid zinc flows obliquely to both sides along the center line of the strip steel, forming a streamline 6 resembling a saddle shape. The Example 1 shown in FIG. 2 is most suitable for the control requirements of the flow of liquid zinc, but the Example 1 results in a rather complicated device because each of the traveling wave magnetic field generators needs to be connected to electrodes and cables and the like. Therefore, it is also feasible and effective to adopt the structure shown in FIG. 3 of the Example 2. The main feature of Example 2 is that the flow separately to the both sides along the center line of the strip steel is changed to the flow to one side by the transversely disposed full-length traveling wave magnetic field generators, and the flow direction is as indicated by arrows 51 and 55. Although the control of the liquid zinc flow in Example 2 is not as efficient as that of Example 1, since the blowing effect of air knife on the liquid zinc flow in the zone III and zone IV of the zinc pot has been largely weakened, it is entirely feasible to drive the flow of the liquid zinc by using full-length traveling wave magnetic field generators. Likewise, the longitudinally disposed traveling wave magnetic field generators shown in FIG. 3, i.e., the first left traveling wave magnetic field generator 73 and the second left traveling wave magnetic field generator 74 can be designed as a full-length left traveling wave magnetic field generator (not shown), the first right traveling wave magnetic field generator 77 and the second right traveling wave magnetic field generator 78 can be designed as a full-length right traveling wave magnetic field generator (not shown).

Figure 4:
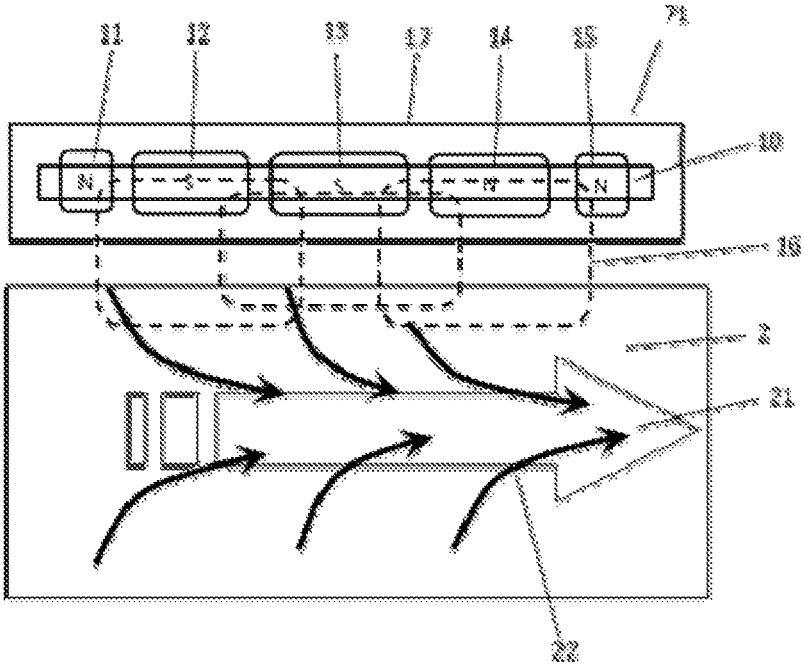
FIG. 4 is a schematic view showing the traveling wave magnetic field generator and the liquid zinc driving principle of the present invention.

FIG. 4 is a schematic view showing the traveling wave magnetic field generators and the liquid zinc driving principle of the present invention. The traveling wave magnetic field generator 71 includes an iron core 10, a plurality of electromagnetic wire windings (11~15) passing through alternating current at a specific frequency, and a shell 17. When the alternating current of different electromagnetic wire windings changes according to different phases, traveling wave magnetic fields are excited (shown as the magnetic line 16). The traveling wave magnetic field generates an electromagnetic driving force for cutting the magnetic line on liquid zinc to drive the flow of the liquid zinc 2, and the flow direction is as indicated by arrows 21 and 22.

The core innovation of the invention lies in that a plurality of traveling wave magnetic field generators are arranged above the surface of the liquid zinc in the zinc pot, so as to excite a traveling wave magnetic field to generate an electromagnetic driving force on the liquid zinc, driving the liquid zinc to flow. Flowing of liquid zinc caused by the traveling wave magnetic field generator can engage with blow-flowing of the air knife. Moreover, by controlling the magnetic field direction and the energizing interval of the traveling wave magnetic field generators, the liquid zinc in the surface layer of the zinc pot flows in an orderly manner, thereby improving the interaction relationship between the flow of liquid zinc and the zinc dross, reducing the manual labor and increasing the unit speed.

The above are only the preferred examples of the present invention and are not intended to limit the scope of the present invention. Therefore, any modifications, equivalent substitutions and improvements made within the spirit and scope of the invention are intended to be included within the scope of the invention.

The invention claimed is:

1. A device for controlling flow of liquid zinc in a zinc pot for hot-dip galvanization, the device comprising:

traveling wave magnetic field generators arranged transversely and longitudinally in the zinc pot; and a control device for the traveling wave magnetic field generators, wherein the traveling wave magnetic field generators comprise left, right, front and back traveling wave magnetic field generators disposed above a surface of the liquid zinc on a left side, a right side, a front end of the zinc pot and a zone between a strip steel and a furnace snout, respectively;

wherein the front traveling wave magnetic field generators and the back traveling wave magnetic field generators constitute transverse traveling wave magnetic field generators, wherein the left traveling wave magnetic field generators and the right traveling wave magnetic field generators constitute longitudinal traveling wave magnetic field generators, wherein the left traveling wave magnetic field generators and the right traveling wave magnetic field generators extend beyond the back traveling wave magnetic field generators to a rear end of the zinc pot, wherein the front traveling wave magnetic field generators comprise a first front traveling wave magnetic field generator and a second front traveling wave magnetic field generator, the back traveling wave magnetic field generators comprising a first back traveling wave magnetic field generator and a second back traveling wave magnetic field generator, wherein the first front traveling wave magnetic field generator and the first back traveling wave magnetic field generator excite a traveling wave electromagnetic field that drives a portion of the liquid zinc in the zinc pot to flow to the left side of the zinc pot, and at a same time, the second front traveling wave magnetic field generator and the second back traveling wave magnetic field generator excite a traveling wave electromagnetic field that drives another portion of the liquid zinc in the zinc pot to flow to the right side of the zinc pot, and wherein the control device for the traveling wave magnetic field generators controls an energizing interval of the traveling wave magnetic field generators, so that the traveling wave magnetic field generators are powered intermittently, to control the liquid zinc to alternate between flowing and non-flowing.

2. The device for controlling flow of liquid zinc in a zinc pot for hot-dip galvanization according to claim 1, wherein the left traveling wave magnetic field generators, the first front traveling wave magnetic field generator, the first back traveling wave magnetic field generator are arranged in symmetry with the right traveling wave magnetic field generators, the second front traveling wave magnetic field generator, the second back traveling wave magnetic field generator on both sides of a center line of a width of the strip steel.

3. The device for controlling flow of liquid zinc in a zinc pot for hot-dip galvanization according to claim 2, wherein the left traveling wave magnetic field generators and the right traveling wave magnetic field generators excite the traveling wave electromagnetic fields that drive the liquid zinc to flow to the rear end of the zinc pot.

4. The device for controlling flow of liquid zinc in a zinc pot for hot-dip galvanization according to claim 1, wherein the left traveling wave magnetic field generators include a first left traveling wave magnetic field generator and a second left traveling wave magnetic field generator, the right traveling wave magnetic field generators include a first right traveling wave magnetic field generator and a second right traveling wave magnetic field generator.

5. The device for controlling flow of liquid zinc in a zinc pot for hot-dip galvanization according to claim 1, wherein the control device for the traveling wave magnetic field generators controls power supply frequency of the traveling wave magnetic field generators to be 0~200 Hz.

6. The device for controlling flow of liquid zinc in a zinc pot for hot-dip galvanization according to claim 5, wherein the control device for the traveling wave magnetic field generators controls power supply frequency of the traveling wave magnetic field generators to be 50~100 Hz.

* * * * *